US008122824B1

(12) United States Patent
Pendleton

(10) Patent No.: US 8,122,824 B1
(45) Date of Patent: Feb. 28, 2012

(54) PNEUMATIC CAN CRUSHING APPARATUS

(76) Inventor: Lillian C. Pendleton, Poland, IN (US)

( * ) Notice: Subject to any disclaimer, the term of this patent is extended or adjusted under 35 U.S.C. 154(b) by 204 days.

(21) Appl. No.: 12/487,521

(22) Filed: Jun. 18, 2009

(51) Int. Cl.
*B30B 1/38* (2006.01)
*B30B 9/32* (2006.01)

(52) U.S. Cl. ..... 100/245; 100/347; 100/269.05; 100/902

(58) Field of Classification Search ..... 100/215, 100/226, 240, 245, 269.01, 269.05, 269.14, 100/269.18, 902, 48, 347
See application file for complete search history.

(56) References Cited

U.S. PATENT DOCUMENTS 2,078,587 A * 4/1937 Sadenwater ..... 108/116
2,817,290 A * 12/1957 Parker et al. ..... 100/102
2,916,985 A * 12/1959 Beach ..... 100/345
3,104,607 A 9/1963 Galas
D286,643 S 11/1986 Carney et al.
5,060,564 A 10/1991 Buford et al.
5,109,763 A 5/1992 Morris et al.
5,174,199 A * 12/1992 King et al. ..... 100/48
5,257,576 A 11/1993 Pearce et al.
5,279,215 A 1/1994 Harder
5,303,643 A 4/1994 Fisher et al.
D360,212 S 7/1995 Zanini
5,624,018 A 4/1997 Schuff et al.
5,678,478 A * 10/1997 Goyal et al. ..... 100/52

* cited by examiner

*Primary Examiner* — Jimmy T Nguyen

(57) ABSTRACT

The present invention features a pneumatic can crushing apparatus for compacting cans comprising a pipe having a piston assembly, wherein the piston assembly is connected to an air compressor via hoses and valves. Compressed air causes the piston assembly to move and crush a can or bottle inside the pipe.

8 Claims, 4 Drawing Sheets

PNEUMATIC CAN CRUSHING APPARATUS

FIELD OF THE INVENTION

The present invention is directed to an apparatus for crushing cans. More particularly, the present invention is directed to an apparatus utilizing an air compressor for compressing cans into flat, easily disposable or recyclable masses.

BACKGROUND OF THE INVENTION

Uncrushed metal cans occupy a considerable amount of space, making it difficult to store or transport large quantities of metal cans. Thus, it is desirable to flatten metal cans before they are stored or transported elsewhere so that more metal cans can be placed in a given space. Furthermore, crushing metal cans presents the material in a form in which is more readily salvageable for reuse and recycling.

The present invention features a pneumatic can crushing apparatus for compacting metal cans or plastic bottles. The pneumatic can crushing apparatus comprises a removable air cylinder inside the pipe. The piston assembly is connected to an air compressor and air tank via hoses and valves. The air from the air compressor and air tank can cause the piston assembly to move upwardly in the pipe so as to crush a metal can or plastic bottle inside the pipe. Without wishing to limit the present invention to any theory or mechanism, it is believed that the can crusher of the present invention facilitates the compaction of metal cans for recycling purposes.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

The following is a listing of numbers corresponding to a particular element refer to herein:

| | |
|---|---|
| 100 | pneumatic can crusher apparatus |
| 150 | can |
| 200 | pipe |
| 210 | outside surface of pipe |

-continued

| | |
|---|---|
| 220 | top end of pipe |
| 230 | bottom end of pipe |
| 250 | inside of the pipe |
| 255 | opening |
| 280 | head of piston assembly |
| 285 | top surface of head |
| 286 | bottom surface of head |
| 290 | connecting rod |
| 300 | safety door |
| 320 | handle |
| 350 | hinge |
| 451 | first hose |
| 452 | second hose |
| 453 | third hose |
| 500 | trip lever |
| 550 | adjustable pop off valve |
| 650 | pressure gauge |
| 660 | safety valve |
| 665 | spring |
| 668 | safety valve lever |
| 670 | cover latch |
| 700 | stand |
| 750 | rubber pad |
| 820 | bottom air cylinder |
| 830 | rubber seal |
| 880 | inner chamber |
| 900 | air vent |
| 945 | air compressor |
| 950 | air tank |
| 960 | pressure regulator |

Figure 1:
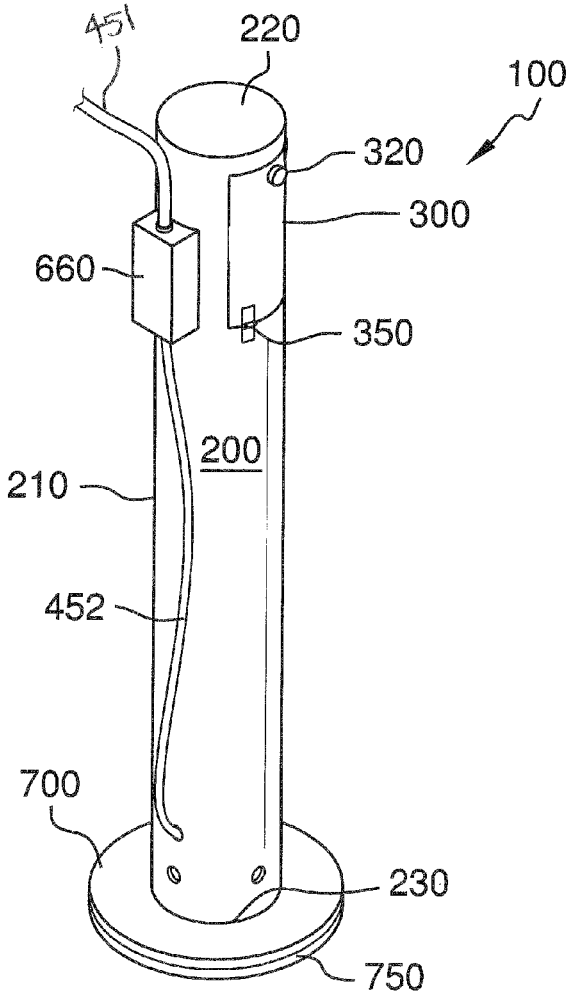
FIG. 1 is a perspective view of the pneumatic can crushing apparatus of the present invention.
Figure 2:
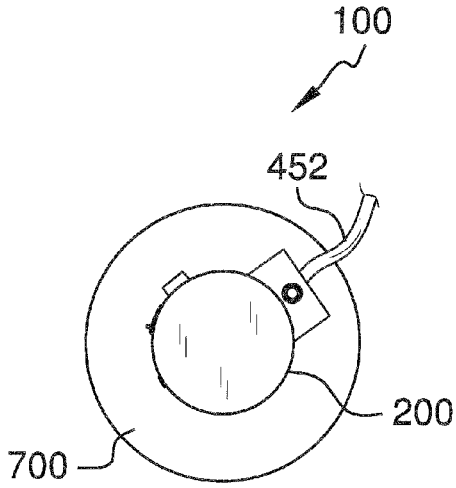
FIG. 2 is a top view of the pneumatic can crushing apparatus of the present invention.
Figure 3:
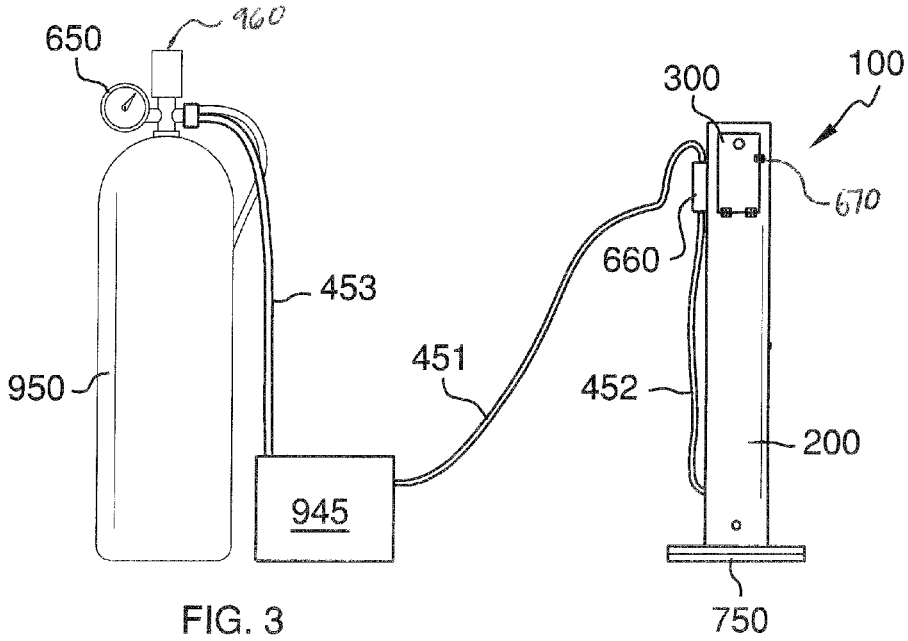
FIG. 3 is a side view of the pneumatic can crushing apparatus of the present invention.
Figure 4:
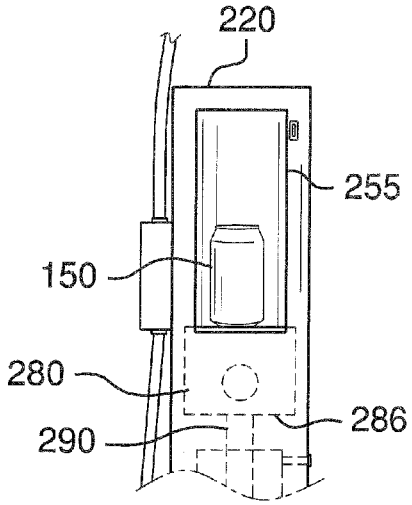
FIG. 4 is a side and internal view of the pneumatic can crushing apparatus of the present invention.
Figure 5:
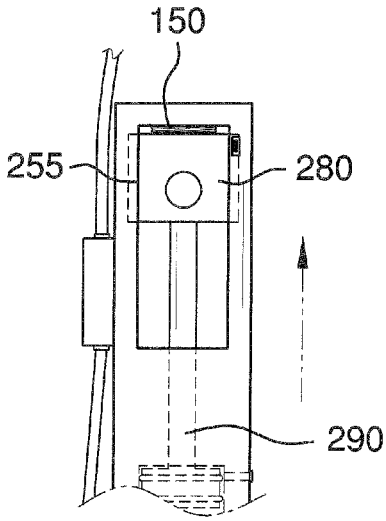
FIG. 5 is a side and internal view of the pneumatic can crushing apparatus of the present invention.
Figure 6:
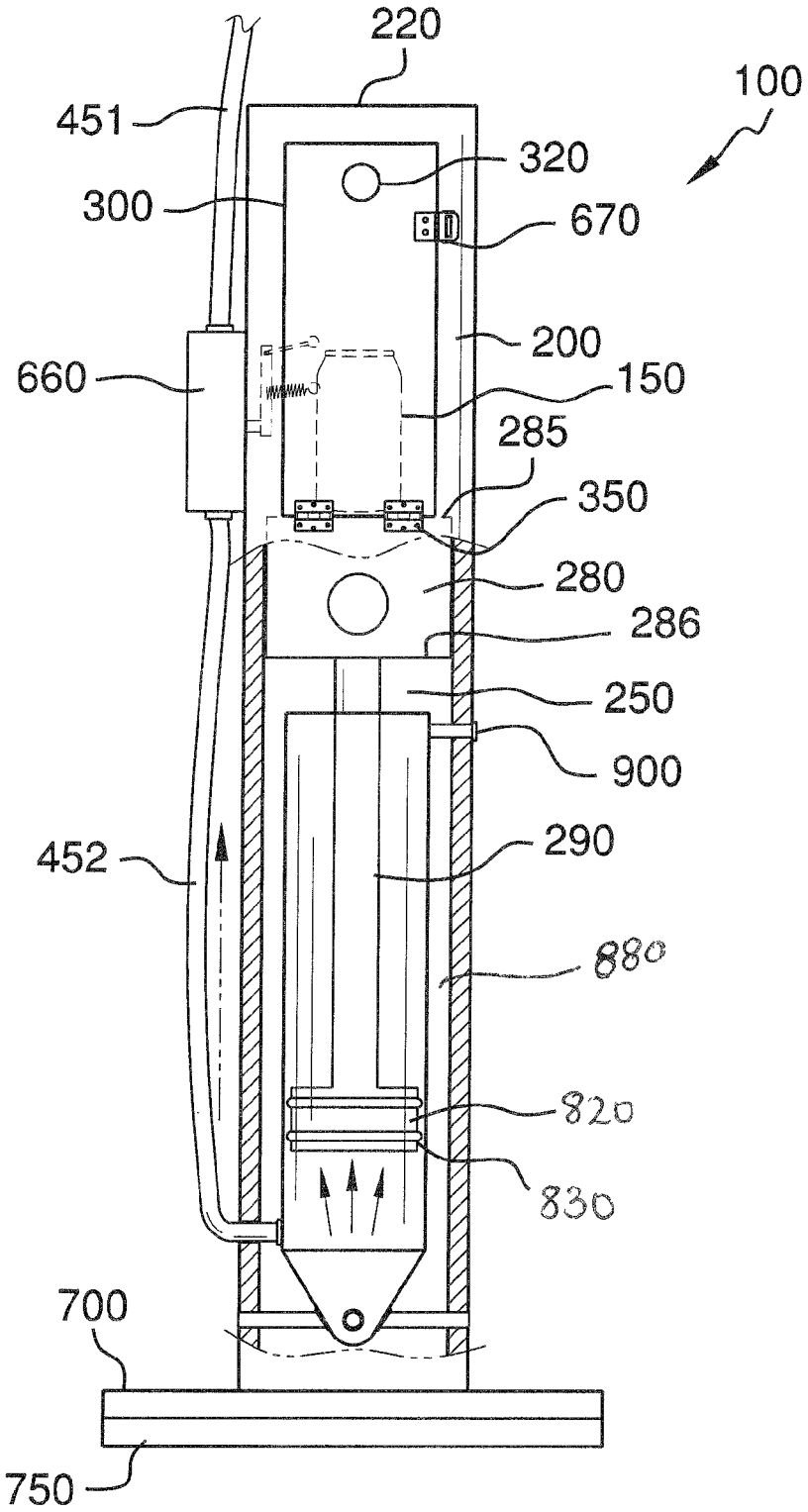
FIG. 6 is a cross sectional view of the pneumatic can crushing apparatus of the present invention.
Figure 7:
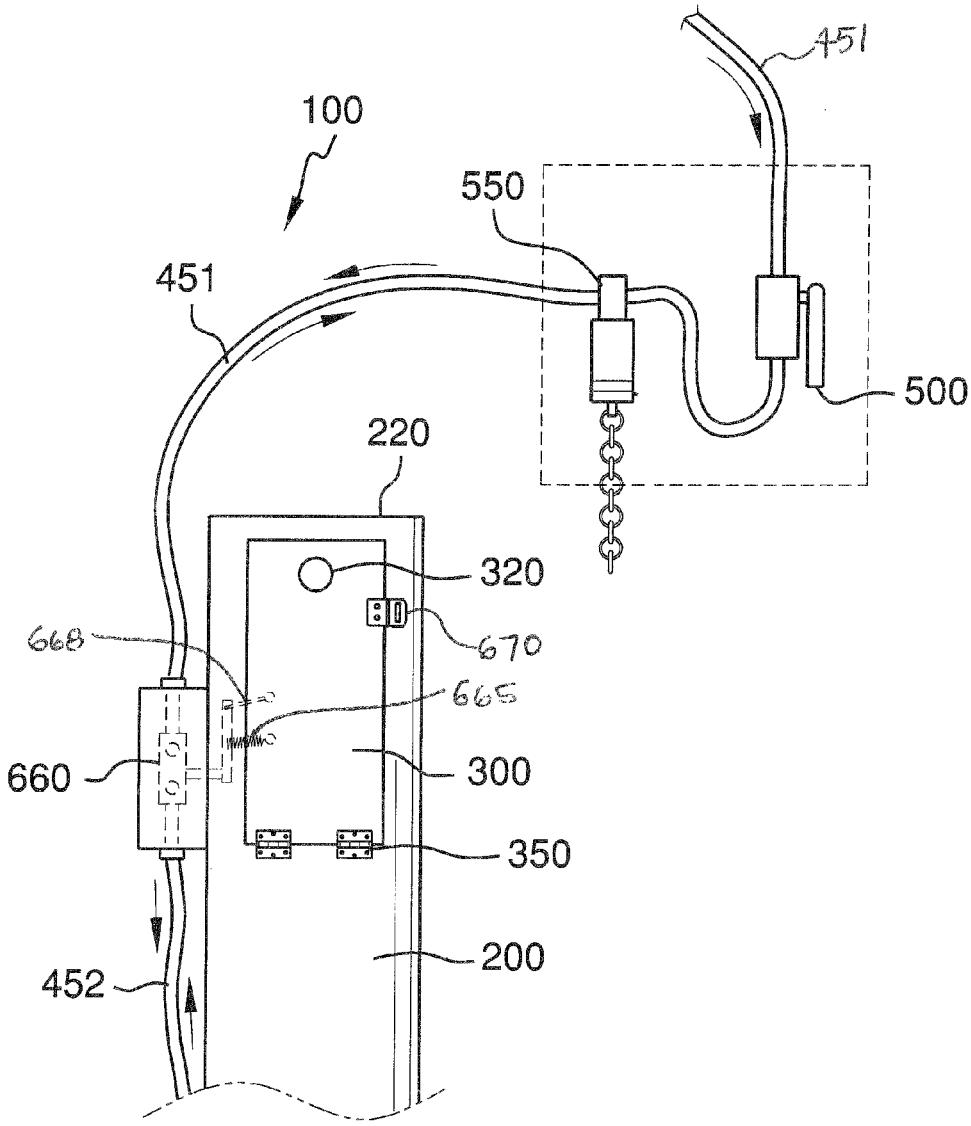
FIG. 7 is a side view of the pneumatic can crushing apparatus of the present invention.

Referring now to FIGS. 1-5, the present invention features a pneumatic can crusher apparatus 100 for compressing metal cans 150 or plastic bottles. The pneumatic can crusher 100 comprises a hollow pipe 200 having an outside surface 210, a top end 220, a bottom end 230, and an inside 250. The top end 220 of the pipe 200 is firmly closed.

The bottom end 230 of the pipe 200 is attached to a stand 700. The stand 700 has a top surface and a bottom surface and helps to keep the pipe 200 in a vertical orientation with respect to the ground surface. A rubber pad 750 may be disposed on the bottom surface of the stand 700, wherein the rubber pad 750 can help to secure the stand 700 to the ground surface. In some embodiments, the rubber pad 750 helps to prevent the stand 700 from slipping on the ground surface.

The pneumatic can crusher apparatus 100 further comprises a piston assembly slidably disposed inside the pipe 200 (e.g., in an inner chamber 880). The piston assembly comprises a head 280 having a top surface 285 and a bottom surface 286, a connecting rod 290 having a first end and a second end, and a bottom air cylinder 820 having a top surface, a bottom surface, and an outer edge. The bottom surface 286 of the head 280 is attached to the first end of the connecting rod 290, and the top surface of the bottom air cylinder 820 is attached to the second end of the connecting rod 290. The bottom air cylinder 820 is housed in the inner chamber 880. In some embodiments, seals 830 surround a portion of the piston assembly.

The piston assembly is oriented such that the top surface 285 of the head 280 faces the top end 220 of the pipe 200 and the bottom surface of the bottom air cylinder 820 faces the bottom end 230 of the pipe 200.

An opening 255 is disposed in the pipe 200 near the top end. The opening 255 is for allowing a metal can 150 or a plastic bottle to be inserted into the inside 250 of the pipe 200 and placed on the top surface 285 of the head 280 of the piston assembly (see FIG. 4).

A safety door 300 for covering the opening 255 in the pipe 200 is pivotally attached to the pipe 200 via a hinge mechanism 350. The safety door 300 is movable between an open and a closed position respectively allowing and preventing access to the inside of the pipe 200 via the opening 255. In some embodiments, a cover latch 670 is disposed on the outside of the pipe near the safety door 300. The cover latch 670 is for securing the safety door 300 in the closed position. In some embodiments, a handle 320 is disposed on the safety door 300 for assisting a user in moving the safety door 300 to the open position or the closed position.

The can crusher apparatus 100 of the present invention further comprises an air compressor 945 connected to an air tank 950, for example via a third hose 453. The apparatus 100 of the present invention is designed such that air from the air compressor 945 and air tank 950 can be directed to push up against the bottom surface of the bottom air cylinder 820 of the piston assembly, which causes the piston assembly to move upwards toward the top end 220 of the pipe 200. This can crush a metal can 150 or plastic bottle that rests on the top surface 285 of the head 280 (see FIG. 5).

Air from the air compressor 945 is delivered via a first hose 451. In some embodiments, a trip lever 500 is disposed on the first hose 451. The trip lever 500 is movable between an open and a closed position respectively turning on and turning off the air compressor 945. Such trip levers are well known to one of ordinary skill in the art.

Disposed on the second end of the first hose 451 is a safety valve 660. In some embodiments, the safety valve 660 is attached to the pipe 200. In some embodiments, a second hose 452 directs air from the safety valve 660 to below the bottom air cylinder 820 (e.g., into the inner chamber 880). The safety valve 660 is movable between an open and a closed position respectively allowing and preventing compressed air to be delivered from the air compressor 945 to the piston assembly via the hoses. When the safety valve 660 is in the closed position, air from the air compressor 945 cannot cause the piston assembly to move. When the safety valve 660 is in the open position, air from the air compressor 945 can be used to move the piston assembly so as to crush a can 150.

In some embodiments, a spring 665 is attached to the safety door 300 and to the safety valve 660 (e.g., via a linker). The spring keeps the door 300 biased in the open position. The safety valve 660 is controlled via a safety valve lever 668. The safety valve lever 668 requires that the door is shut by the user before the piston can move up The safety valve lever 668 causes the safety valve 660 to be pulled to the closed position when the safety door 300 is moved to the open position. The safety valve lever 668 causes the safety valve 660 to be pushed the open position when the safety door 300 is moved to the closed position. This prevents the piston assembly from moving when the safety door 300 is opened so as to prevent an injury.

In some embodiments, moving the safety door 300 to the closed position and turning the trip valve 500 to the open position causes compressed air to move the piston upwards towards the top surface 220 of the pipe 200 to crush the metal can 150 or plastic bottle inside the pipe. In some embodiments, the apparatus 100 of the present invention is designed to crush a can 150 only when the safety door 300 is in the closed position.

In some embodiments, the pneumatic can crushing apparatus 100 comprises a vent 900 for helping to allow pressure (e.g., air) to escape from the air cylinder.

In some embodiments, the pneumatic can crushing apparatus 100 of the present invention further comprises a pop-off valve 550. The pop-off valve 550 can help return to the closed position after the piston assembly has moved upward in the pipe 200 to crush a can 150. For example, the pop-off valve 550 allows air to be exhausted so that the bottom air cylinder can be lowered down to its starting position.

In some embodiments, the pneumatic can crushing apparatus 100 of the present invention further comprises a pressure regulator 960 connected to the air tank 950 and air compressor 945. In some embodiments, the pressure regulator 960 is set to 80 pounds per square inch (psi). In some embodiments, the can crushing apparatus 100 comprises a pressure gauge 650.

In some embodiments, the present invention is used with a standard air compressor. Air compressors are well known to those of ordinary skill in the art.

In some embodiments, the safety valve 660 and/or pop-off valve 550 and/or trip lever 500 is a ½ inch quarter turn valve (e.g., ½ inch pipe fitting, ½ inch inside diameter).

In some embodiments, the bottom air cylinder 820 has a diameter of about 3.25 inches. In some embodiments, the bottom air cylinder 820 has a diameter between about 2 to 4 inches. In some embodiments, the bottom air cylinder 820 has a diameter greater than about 4 inches.

As used herein, the term "about" refers to plus or minus 10% of the referenced number. For example, an embodiment wherein the pipe 200 is about 50 inches tall includes a pipe 200 that is between 45 and 55 inches tall.

The apparatus 100 of the present invention may be constructed in a variety of sizes. For example, in some embodiments, the pipe 200 is about 48 inches tall as measured from the top edge 220 to the bottom edge 230. In some embodiments, the pipe is between 24 to 36 inches tall as measured from the top edge 220 to the bottom edge 230. In some embodiments, the pipe 200 is between about 36 to 48 inches tall as measured from the top edge 220 to the bottom edge 230. In some embodiments, the pipe 200 is between about 48 to 60 inches tall as measured from the top edge 220 to the bottom edge 230.

In some embodiments, the pipe 200 is about 6 inches in diameter. In some embodiments, the pipe 200 is between about 4 to 6 inches in diameter. In some embodiments, the pipe 200 is between about 6 to 8 inches in diameter. In some embodiments, the pipe 200 is between about 8 to 10 inches in diameter.

In some embodiments, the head 280 of the piston assembly is about 5.75 inches in diameter. In some embodiments, the head 280 of the piston assembly is between about 3 to 5 inches in diameter. In some embodiments, the head 280 of the piston assembly is between about 5 to 10 inches in diameter.

In some embodiments, the stand 700 is circular. In some embodiments, the stand 700 is about 20 inches in diameter. In some embodiments, the stand 700 is between about 10 to 20 inches in diameter. In some embodiments, the stand 700 is between about 20 to 30 inches in diameter.

In some embodiments, the first hose 451 and/or second hose 452 are about 0.5 inches in diameter. In some embodiments, the first hose 451 and/or the second hose 452 are between about 0.5 and 1.0 inches in diameter. In some embodiments, the first hose 451 and/or second hose 452 are between about 2.0 to 3.0 inches in diameter.

The following the disclosures of the following U.S. Patents are incorporated in their entirety by reference herein: U.S. Pat. No. 5,303,643; U.S. Pat. No. 3,104,607; U.S. Pat. No. 5,257,576; U.S. Pat. No. 5,060,564; U.S. Pat. No. 5,109,763; U.S. Pat. No. 5,624,018; U.S. Pat. No. 5,279,215.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A pneumatic can crusher for compressing a metal can or a plastic bottle, said pneumatic can crusher comprising:

(a) a hollow pipe having a top end, a bottom end, an outside, and an inside; wherein the top end of the pipe is closed and the bottom end is attached to a stand;

(b) a piston assembly disposed inside the pipe near the bottom end, said piston assembly comprising a head attached to a first end of a connecting rod and a bottom air cylinder connected to a second end of the connecting rod; wherein the piston assembly is oriented such that the head faces the top end of the pipe and the bottom air cylinder faces the bottom end of the pipe; wherein the bottom air cylinder is inside an inner cavity;

(c) an opening disposed in the pipe near the top end, wherein the opening is for allowing the metal can to be inserted into the inside of the pipe and placed on a top surface of the head of the piston assembly;

(d) a safety door for covering the opening in the pipe pivotally attached to the pipe via a hinge mechanism, wherein the safety door is movable between an open and a closed position respectively allowing and preventing access to the inside of the pipe via the opening;

(e) an air compressor connected to an air tank, wherein air from the air compressor is directed to a safety valve via a first hose, wherein the safety valve is movable between open and a closed position respectively allowing and preventing compressed air to be delivered from the air compressor to the piston assembly via a second hose; and wherein air from the air compressor push the air cylinder upward toward the top end of the pipe so to crush the metal can on the top surface of the head of the piston assembly.

2. The pneumatic can crushing apparatus of claim 1 further comprising a rubber pad disposed on a bottom surface of the stand for helping to prevent the stand from slipping on a ground surface.

3. The pneumatic can crushing apparatus of claim 1, wherein a trip lever is connected to the first hose that can move between open and a closed position respectively allowing or preventing air travelling from the air compressor to the safety valve.

4. The pneumatic can crushing apparatus of claim 1 further comprising a cover latch disposed on the outside of the pipe near the safety door for securing the safety door in the closed position.

5. The pneumatic can crushing apparatus of claim 1 further comprising a handle disposed on the safety door.

6. The pneumatic can crushing apparatus of claim 1, wherein a vent is disposed in the inner cavity with the air cylinder for allowing air to enter and exit the inside of the inner cavity with the air cylinder when the piston assembly moves.

7. The pneumatic can crushing apparatus of claim 1 further comprising a spring connecting the safety door to the safety valve, wherein the spring causes the door to be biased in the open position.

8. The pneumatic can crushing apparatus of claim 1 further comprising a pop-off valve for allowing the bottom air cylinder to return to its original position.

* * * * *